United States Patent [19]

Dunphy et al.

[11] 4,382,349

[45] May 10, 1983

[54] WINDOW OPERATOR

[75] Inventors: Gerald F. Dunphy, Glen Waverly; Donald J. Newman, Somerville, both of Australia

[73] Assignee: Ogden Industries Pty. Limited, Melbourne, Australia

[21] Appl. No.: 166,685

[22] Filed: Jul. 1, 1980

[30] Foreign Application Priority Data

Jul. 17, 1979 [AU] Australia ..... PD9601

[51] Int. Cl.[3] ..... E05F 11/00

[52] U.S. Cl. ..... 49/325

[58] Field of Search ..... 292/262, 264; 49/324, 49/325, 356, 357

[56] References Cited

U.S. PATENT DOCUMENTS

| | | | |
|---|---|---|---|
| 350,896 | 10/1886 | Ruddell | 49/325 |
| 3,911,802 | 10/1975 | Morden | 49/325 X |
| 4,014,136 | 3/1977 | Hemens et al. | 49/325 |

FOREIGN PATENT DOCUMENTS

| | | | |
|---|---|---|---|
| 959957 | 6/1964 | United Kingdom | 49/325 |
| 1091528 | 11/1967 | United Kingdom | 49/325 |

*Primary Examiner*—Kenneth Downey

*Attorney, Agent, or Firm*—Berman, Aisenberg & Platt

[57] ABSTRACT

An operator for hinged windows and being of the kind including a chain which can flex in one direction only and which provides the support whereby the window is held open. Movement of the chain into and out of the operator housing is controlled by a sliding actuator which is moveable along an elongate guide track between two extreme positions corresponding to the window closed and fully opened positions respectively. The actuator can be retained in any selected position between the two extremes by engagement between a spring loaded detent and a toothed rack. The detent is carried by the actuator and the rack is fixed relative to the guide track. Release of the detent is effected by moving a lever connected to the detent against a fixed handle of the actuator and the actuator can be moved along the guide track while the lever and handle are so engaged. When the actuator is in the window closed position, the detent can be moved into a camming and locking recess by separation of the lever and handle and engagement of the detent with that recess causes an associated window to be drawn firmly into the closed position and also positively locks the actuator in the window closed position.

11 Claims, 10 Drawing Figures

18
16
14
IV
IV
25
23
24
17
31
30
28
29
31
26
V
14
3
13
4
III
39
34
37
38
32
36
III
26
V 4
36
14
13
32
22
24
29
3
42
31
19
9
35
25
26
23
12
10
11
18
21
17
2

14
22
24
42
29
19
28
26
23
8
7
1
5
25
6
20
18
21
27
17

31
31
28
13
36
32
9
3
33
34
43
44
14
42
15
40
34
30
29
38
39
41
37
26
5
8
27
7
1
20
6

WINDOW OPERATOR

This invention relates to window operators of the kind used to control opening and closing movement of a hinged window. Hinged windows may be of the awning type which are hinged along an upper edge, or of the casement type which are hinged along a side edge. The invention is applicable to both types but will be described with particular reference to awning windows.

One form of window operator commonly used utilizes a length of chain to apply opening and closing force to the window. The chain is of a special kind in that it will flex in one direction only and consequently can form a rigid support to hold the window open. Such chains are well known and will not be described in detail in this specification. Inward and outward movement of the chain is effected through a co-operating sprocket which is rotated through actuating mechanism comprising a worm drive and a handle for operating the worm drive.

In a typical situation involving a standard window, 28 turns of the handle are required to open the window a distance of 14 inches. With the advent of narrow window sills however, the sprocket size has been reduced so that an even greater number of turns is required to move the window through a given distance. Multi-start worms have been adopted in order to reduce the number of handle turns, but that has the disadvantage of disturbing the self-locking characteristics of the worm drive.

It is a principle object of the present invention to provide a window operator which overcomes or at least alleviates the aforementioned problems.

According to the present invention, there is provided a window operator including, an elongate guide track, an actuator mounted on said guide track for sliding movement therealong between two extreme positions corresponding to window closed and fully opened positions respectively, a length of chain having an inner end connected to said actuator for movement therewith and an outer end attachable to a window to be controlled by said operator, and retaining means operable to releasably hold said actuator at any one of a plurality of selected positions between said two extreme positions.

The essential features of the invention, and further optional features, are described in detail in the following passages of the specification which refer to the accompanying drawings. The drawings however, are merely illustrative of how the invention might be put into effect, so that the specific form and arrangement of the features (whether they be essential or optional features) shown is not to be understood as limited on the invention.

A fundamental distinction between the operator of the present invention and prior operators of the same general kind is that the actuator is moved linearly rather than being rotated in order to initiate window movement. The path of movement of the actuator is preferably straight and therefore truly linear, but in some situations the path may be curved or otherwise not strictly straight and the term "linear" is to be understood as extending to those situations. In broad terms, the actuator is movable between two extreme positions by a sliding motion and those positions respectively correspond to a fully closed position and a fully open position of an associated window. That basic concept could be embodied in many different forms, but one particular form will be hereinafter described as an example application of the invention.

Figure 1:
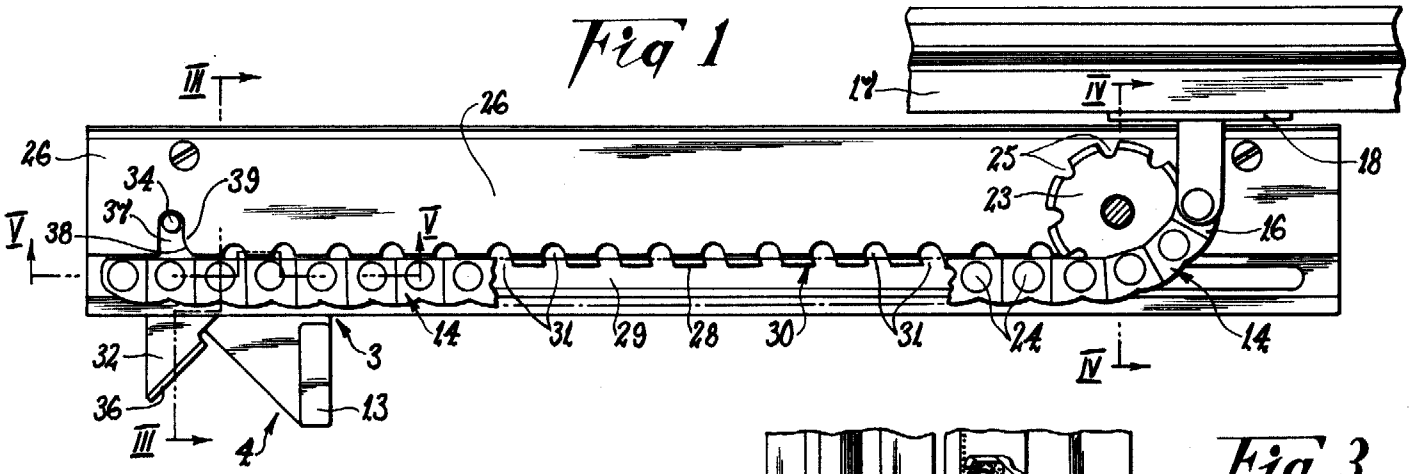
FIG. 1 is a plan view of an operator incorporating one embodiment of the present invention with the outer housing removed and showing the actuator at the window closed position.

In a preferred form shown in the drawings the operator includes an elongate guide track 1 which can be secured to a window sill 2 (FIG. 3) and a slide member 3 forming part of the actuator 4 and being mounted on the track 1 for sliding movement between two extreme positions as previously mentioned. In FIG. 1, the actuator 4 is shown in the position corresponding to the window closed position. The guide track 1 may be formed by a metal section 20 of any appropriate form, preferably having a substantially flat side face 5 as shown and a longitudinally extending channel 6 formed in that face 5 adjacent a top edge thereof. A lip 7 is preferably provided along one side of the open mouth of the channel 6 so as to provide a restricted opening 8 for a purpose hereinafter made clear (see FIG. 4).

Figure 3:
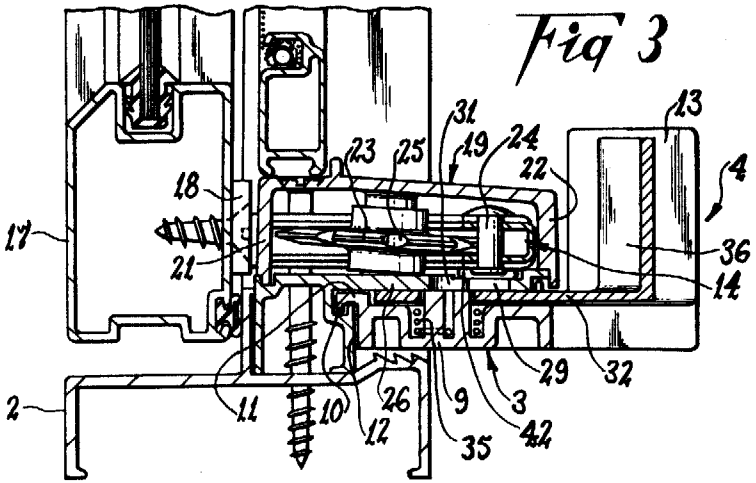
FIG. 3 is an enlarged cross-sectional view taken along Line III—III of FIG. 1.
Figure 4:
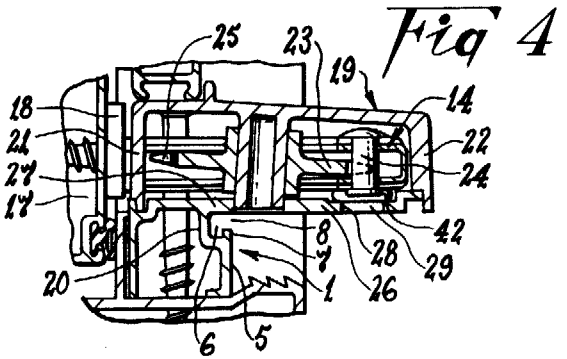
FIG. 4 is an enlarged cross-sectional view taken along Line IV—IV of FIG. 1.

The slide member 3 includes a body 9 which may be formed of a plastics material and has a rib 10 which slidably locates within the guide channel 6 (FIG. 3). A web section 11 connects the rib 10 to the body 9 and that web 11 is dimensioned to extend through the narrow opening 8 of the channel 6 and thereby locate the rib 10 and body 9 of the slide member 3 on respective opposite sides of the lip 7 of the guide track 1. A side 12 of the slide member body 9 may slidably bear against the flat side face 5 of the guide section 20 as shown in FIG. 3 and a handle 13 projects outwardly from the slide member body 9 to enable convenient movement of the slide member 3 backwards and forwards along the guide track 1. The handle 13 may be a plate like member or it may be of any other suitable form.

It will be appreciated that other slide arrangements may be adopted with equal effectiveness.

A length of chain 14 of the kind commonly used with window operators has an inner end 15 secured to the slide member 3 and its opposite outer end 16 is adapted to be secured to a window frame 17 (FIG. 3) through an appropriate bracket 18 or the like. It is preferred that the chain length 14 is substantially fully contained within the operator when the actuator 4 is at the window closed position (FIG. 1) and for that purpose a hollow housing section 19 may be secured over the guide section 20. The housing section 19 is preferably elongated to extend the full length of the guide section 20 and has an opening (not shown) in a front longitudinal wall 21 adjacent one end through which the chain 14 is connected to the window frame 17. The slide member handle 13 projects beyond the opposite rear wall 22 of the housing 19 for manual engagement. Guide means holds the chain 14 to a particular path of movement within the operator housing 19 and in use its path of movement outside the housing is controlled by its attachment to the window frame 17.

In the preferred construction shown, the aforementioned guide means includes a roller or wheel 23 rotatably mounted within the housing 19 adjacent the front wall opening and which is engaged by the chain 14 to achieve a substantially 90° change of direction of the chain 14 between stored and active portions of the chain 14. The stored portion is that portion extending between the wheel 23 and actuator 4, whereas the active portion extends between the wheel 23 and the window frame 17. Naturally the relative proportions of those portions varies according to the position of the actuator 4 along the guide track 1.

According to the form shown, the wheel 23 has a sprocket like periphery so that link connecting rivets 24 of the chain 14 locate within recesses 25 of that periphery (FIG. 1) and ensure rotation of the wheel 23 as the chain 14 is moved towards or away from the housing opening. The slide member 3 also forms part of the chain guide means in that its connection with the inner end portion of the chain 14 holds that end portion to a particular path of travel within the operator housing 19. That connection is preferably adjacent the end of the slide member 3 furtherest from the outer end 16 of the chain 14 so that the slide member 3 can move beyond the chain wheel 23 to adopt the window fully opened position without disturbing engagement between the chain 14 and the wheel 23.

Retaining means is provided for holding the actuator 4, and consequently the chain 14, at any one of several positions between the fully closed and fully open positions. Such retaining means may include a toothed rack and a detent co-operable with that rack and carried by the slide member. In the arrangement shown, the toothed rack is formed on a flange section 26 secured to and extending laterally from the guide section 20. That flange section 26 may be formed integral with the guide section 20 and may, as shown, comprise a lateral extension of one side wall 27 of the track channel 6. Furthermore, the flange section 26 preferably extends the full length of the guide section 20 and in the arrangement shown the rack 30 is formed by one edge 28 of a slot 29 which extends longitudinally of the flange 26 for substantially the full length thereof. The rack 30 is created by a plurality of recesses 31 formed in the slot edge 28 and any suitable spacing may be provided between those recesses 31.

Figure 2:
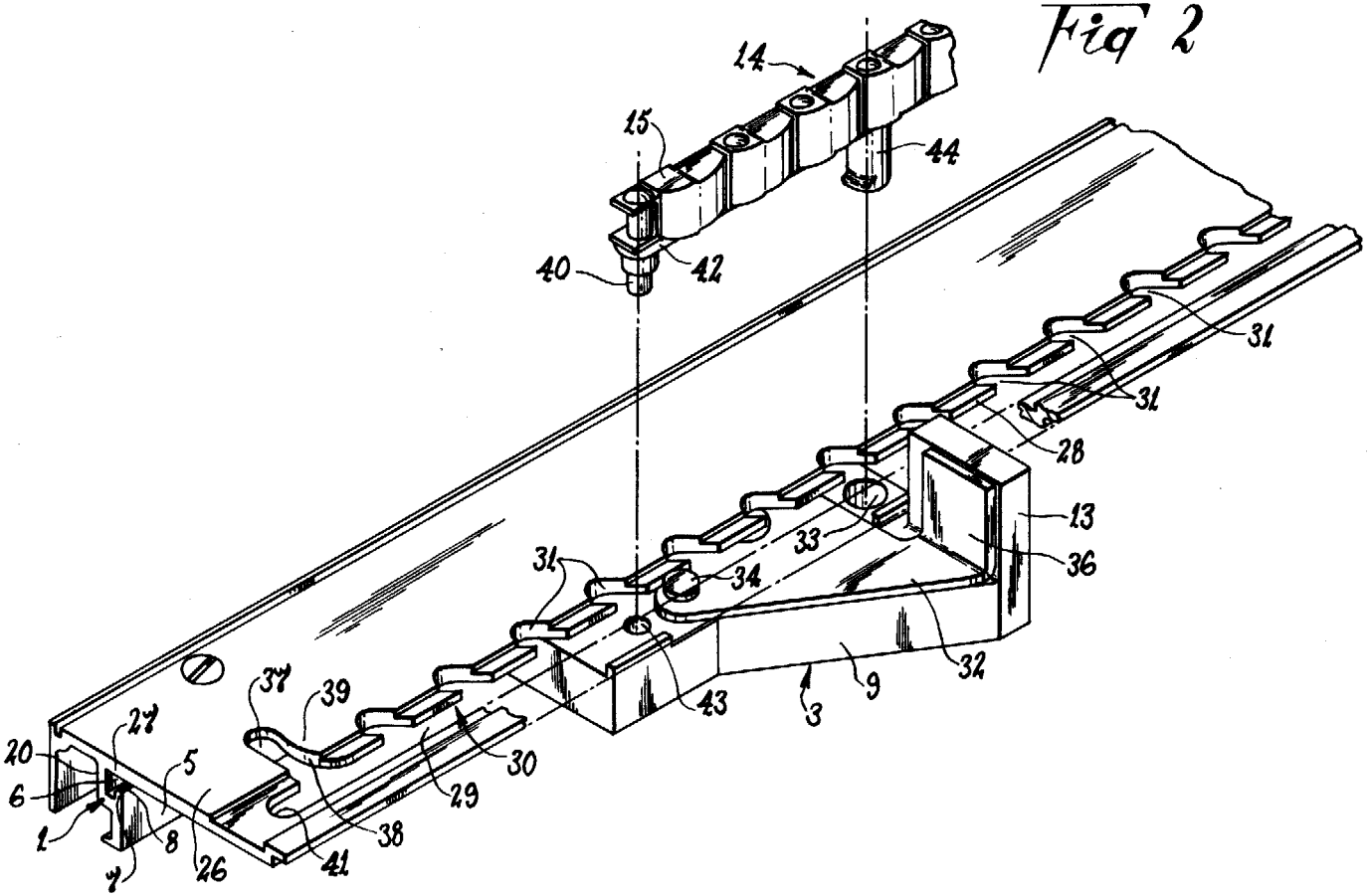
FIG. 2 is an enlarged exploded perspective view of part only of the construction shown in FIG. 1.
Figure 8:
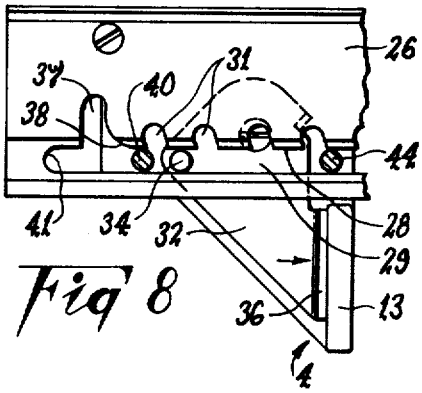
FIG. 8 is a view similar to FIG. 7 showing the detent free from the rack and the actuator moved towards the window fully opened position.
Figure 9:
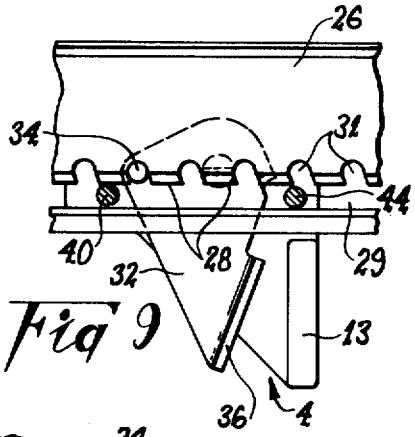
FIG. 9 is a view similar to FIG. 8 showing the detent engaging the rack to hold the actuator in a window open position.

The detent as shown includes a plate 32 pivotally connected at 33 (FIG. 2) to the slide member body 9 and having a laterally projecting pin 34 which is adapted to engage in any selected one of the rack or locating recesses 31 (FIG. 9). The arrangement is such that movement of the slide member 3 in either direction is prevented whilst the detent pin 34 is so engaged. Biasing means such as a spring 35 may act between the slide member 3 and the detent plate 32 to urge the plate 32 in a direction such as to ensure engagement between the detent pin 34 and the rack 30. Manual release of the detent pin 34 may be effected through manipulation of a lever 36 secured to the detent plate 32 and located at an accessible position at the rear side of the housing 19. The detent lever 36 and slide member handle 13 may be arranged side by side as shown so that the lever 36 can be pressed against the handle 13 to achieve the detent release condition (FIGS. 1 and 8) and the lever 26 and handle 13 are held together during movement of the slide member 3 lengthwise of the operator housing 19.

Figure 7:
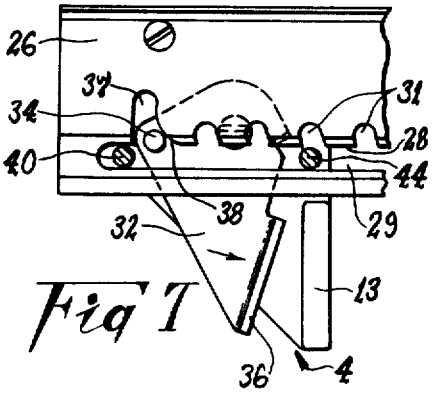
FIG. 7 is a view similar to FIG. 6 but showing the locking detent partially released from the locking recess at the window closed position.

Locking means may be provided to securely retain the actuator 4 in the window closed position and in the form shown that makes use of the detent as described. In that form, a locking recess 37 is formed in the slot edge 28 at a position corresponding to the location of the detent pin 34 at the fully closed condition of the operator. The recess 37 is deeper than the locating recesses 31 and the side edge closest the guide wheel 23 is preferably contoured to form a cam surface 38. The shape of the cam surface 38 is such that in the window closed position of the operator, the detent pin 34 locates within the locking recess 37 but is held by a hump 39 of the cam surface 38 against penetrating into the recess 37 to a depth significantly different to that allowed by the shallower locating recesses 31 (FIG. 7). Furthermore, the cam surface 38 may slope outwardly from the hump 39 towards the adjacent locating recess 31 (FIGS. 1 and 2) so that the detent pin 34 will self-release from the outer part of the locking recess 37 when the slide member 3 is urged towards the window open position.

In order to achieve the locked condition, the detent lever 36 is moved away from the slide member handle 13 so as to force the detent pin 34 over the cam surface hump 39 and into the inner part of the locking recess 37. Release of that locked condition therefore requires application of force directly to the detent lever 36 so as to move the detent pin 34 back to the outer side of the cam hump 39. If desired, the detent pin 34 may be in the form of a freely rotatable roller so as to facilitate movement over the cam hump 39. It is of course preferred to positively locate the slide member 3 against bodily movement beyond the position at which the detent pin 34 can rest on the top side of the cam hump 39 and that can be achieved through use of any suitable stop means (not shown).

Figure 5:
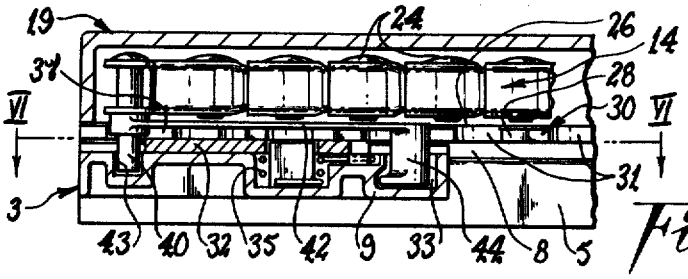
FIG. 5 is an enlarged cross-sectional view taken along Line V—V of FIG. 1.
Figure 6:
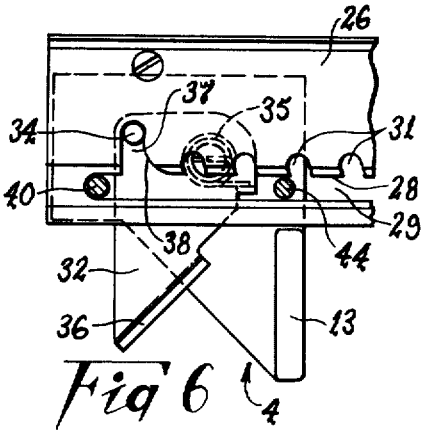
FIG. 6 is a cross-sectional view taken along Line VI—VI of FIG. 5.
Figure 10:
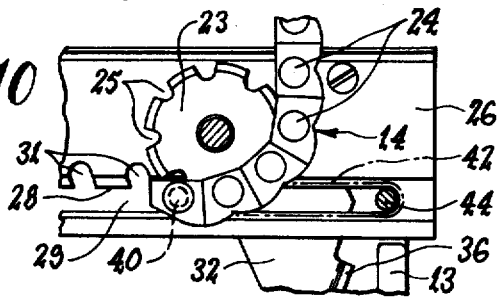
FIG. 10 is a view showing the actuator at the window fully opened position.

The slide member body 9 and the chain 14 are preferably located, as shown, on respective opposite sides of the flange section 26 and the connection between the slide member 3 and the chain 14 may be provided through the slot 29. In the construction shown, the connection between those members includes a pin 40 which can co-operate with the end 41 of the slot 29 to form the aforementioned stop means (see FIG. 5). Such an arrangement also adds to the stability of the slide member 3 relative to the guide track 1. Since the chain 14 is therefore caused to slide along the upper side of the flange section 26, a suitable bearing may be provided between it and the adjacent flange surface. Such a bearing may be formed of a strip 42 of suitable plastics material fastened at one end to the chain 14 through the pin 40 which may also locate within a hole 43 of the slide member body 9. The other end of the bearing strip 42 may be connected to the slide member 3 through a lug 44 projecting through the flange slot 29. The pin 40 preferably provides the only connection between the chain 14 and the slide member 3 so that the inner end portion of the chain cam swing outwardly towards the window frame 17 when located at the wheel 23 (see FIG. 10). The lug 44 preferably serves as a pivot mounting for the detent plate 32.

It will be appreciated from the foregoing description that the invention provides a relatively simple yet effective operator for hinged windows. The length of the operator housing 19 can be varied to suit different degrees of maximum window opening. Actuation of the operator is extremely simple in that it only requires a squeeze action between the actuator handle 13 and the detent lever 36 to release the slide for movement to any selected position. Locking of the operator in the fully closed position is also simple and release of the lock requires the same action as for normal movement except that a slightly greater force may be required to achieve the initial release. A feature of the locking action is that it draws an associated window more firmly back against the fixed frame and thereby inhibits passage of draughts.

Finally, it is to be understood that various alterations, modifications and/or additions may be introduced into the constructions and arrangements of parts previously described without departing from the spirit or ambit of the invention as defined by the appended claims.

Having now described our invention, what we claim as new and desire to secure by Letters Patent is:

1. A window operator including an elongate guide track and a flange projecting outwardly from said guide track and extending along substantially the entire length of the guide track, said flange having a slot which extends substantially parallel to said guide track, a manually operable actuator mounted on said guide track and extending beyond said flange for sliding movement therealong between two extreme positions corresponding to window closed and fully open positions respectively, a length of chain having an inner end connected to said actuator for movement therewith and an outer end attachable to a window to be controlled by said operator, guide means co-operating with said chain to cause a stored portion of said chain to generally follow the path of said guide track, said stored position including and extending from said chain inner end, an active portion of said chain extending between said guide means and said chain outer end and the relative proportions of said stored and active portions varying according to the position of said actuator along said track said chain stored portion and said actuator being located on opposite sides of said flange and being interconnected by connecting means extending through said slot, and retaining means operable to releasably hold said actuator at any one of a plurality of selected positions between said two extreme positions.

2. A window operator according to claim 1, wherein a housing is connected to said guide track and contains said chain stored portion, an opening is provided through a front wall of said housing, and said chain active portion emerges from said housing through said opening.

3. A window operator according to claim 2, wherein said guide means includes a wheel rotatably mounted within said housing and which engages said chain at the junction between said stored and active portions thereof, said wheel being located adjacent said housing front wall opening, and said chain being bent around part of said wheel when said actuator is located between said two extreme positions thereof so that said active and stored portions of the chain are substantially at 90° relative to one another.

4. A window operator including, a guide track comprising an elongate member, a channel formed through a face of said member and extending longitudinally thereof, a lip extending along one side of the open mouth of said channel to provide a restricted opening for that channel, an actuator mounted on said guide track for sliding movement therealong between two extreme positions corresponding to window closed and fully open positions respectively, said actuator including a slide member having a body which is located externally of said channel and which has a side thereof arranged for enagement with said face of the elongate member, a rib connected to said slide member body and being slideably located within said channel, a web section forming the connection between said rib and said slide member body and extending through said narrow opening of said guide track member, a length of chain having an inner end connected to said actuator for movement therewith and an outer end attachable to a window to be controlled by said operator, and retaining means operable to releasably hold said actuator at any one of a plurality of selected positions between said two extreme positions.

5. A window operator according to claim 4, wherein a flange section is connected to and projects outwardly from said guide track member and extends substantially the full length of the said guide track, a slot is formed through said flange section and extends substantially parallel to said guide track, said chain stored portion and said actuator slide member are located on respective opposite sides of said flange section and are interconnected by connecting means extending through said slot.

6. A window operator according to claim 5, wherein said connecting means includes an elongate bearing member which is interposed between said chain stored portion and a side of said flange section and slideably bears against that side, one end portion of said bearing member is connected to both said chain inner end and said actuator slide member through a pin extending through said slot, the opposite end of said bearing member is connected to said actuator slide member by way of a lug also extending through said slot, said opposite end being located between said one end and the window fully opened position of said actuator.

7. A window operator according to claim 6, wherein said connecting pin abuts an end of said slot to provide stop means for locating said actuator in said window closed position.

8. A window operator according to claim 5, wherein said retaining means includes a series of spaced locating recesses formed in one longitudinal edge of said slot, a detent carried by said actuator slide member for movement therewith and being locatable within any one of said locating recesses to prevent movement of said slide member along said guide track, a biassing spring urging said detent towards an operative position at which it engages within a said locating recess, and a release lever connected to said detent and being moveable relative to said slide member to move said detent into an inoperative position at which said slide member is free to move relative to said guide track.

9. A window operator including, an elongate guide track, an actuator mounted on said guide track for sliding movement therealong between two extreme positions corresponding to window closed and fully open positions respectively, a length of chain having an inner end connected to said actuator for movement therewith and an outer end attachable to a window to be controlled by said operator, a toothed rack extending substantially parallel to said guide track and being fixed relative thereto, a detent attached to said actuator for movement therewith and being co-operable with said rack to retain said actuator in a selected one of a plurality of positions between said two extreme positions, and release means attached to said detent to permit selective disengagement of said detent from said rack.

10. A window operator according to claim 9, wherein a cam surface is provided on a member fixed to said guide track, and is located so as to be engageable by said detent when said actuator is at the window closed position, said detent engaging and moving across said cam surface during movement between a release position at which said actuator is free to move along said guide track and a locking position at which said actuator is held against such movement, and said cam surface is contoured to cause said actuator to be drawn away from said window fully opened position as said detent moves across that surface and to resist movement of said detent out of said locking position.

11. A window operator according to claim 10, wherein a handle is connected to said actuator, said detent release means includes a lever moveable relative to said actuator handle, and said detent is moved into said locking position by separation of said lever and handle.

* * * * *